US008115574B2

(12) United States Patent
Adkins

(10) Patent No.: US 8,115,574 B2
(45) Date of Patent: Feb. 14, 2012

(54) LOW PASS FILTER WITH EMBEDDED RESONATOR

(75) Inventor: Michael Joseph Adkins, Fruitland, MD (US)

(73) Assignee: Alcatel Lucent, Paris (FR)

( * ) Notice: Subject to any disclaimer, the term of this patent is extended or adjusted under 35 U.S.C. 154(b) by 567 days.

(21) Appl. No.: 12/275,523

(22) Filed: Nov. 21, 2008

(65) Prior Publication Data

US 2010/0127801 A1 May 27, 2010

(51) Int. Cl.
*H01P 1/202* (2006.01)

(52) U.S. Cl. ..... 333/207; 333/24 C; 333/223

(58) Field of Classification Search ..... 333/202, 333/204, 206, 207, 24 C, 219, 219.1, 222, 333/223

See application file for complete search history.

(56) References Cited

U.S. PATENT DOCUMENTS

| | | | | |
|---|---|---|---|---|
| 2,641,646 | A | 6/1953 | Thomas | |
| 3,144,624 | A | 8/1964 | Rypinski | |
| 3,659,232 | A | 4/1972 | Foley | |
| 3,872,412 | A * | 3/1975 | Seidel | 333/202 |
| 3,909,755 | A | 9/1975 | Kaunzinger | |
| 6,255,920 | B1 | 7/2001 | Ohwada et al. | |
| 6,836,198 | B2 | 12/2004 | Engst | |
| 6,861,929 | B2 | 3/2005 | Tsunoda et al. | |
| 2003/0001697 | A1 * | 1/2003 | Bennett et al. | 333/202 |

* cited by examiner

*Primary Examiner* — Benny Lee
*Assistant Examiner* — Hardadi Sumadiwirya
(74) *Attorney, Agent, or Firm* — Kramer & Amado P.C.

(57) ABSTRACT

An embedded resonator sharpens the frequency characteristics of a coaxial low pass filter. The resonator introduces finite transmission zeros to the response of the low pass filter, thereby suppressing spurious modes occurring just above the operating frequency. Two parameters are used to tune the operation of the embedded resonator. The length of an insert into the filter's transmission line substantially controls the resonant frequency, and the gap width substantially controls the coupling of the embedded resonator to the low pass filter.

9 Claims, 6 Drawing Sheets

LOW PASS FILTER WITH EMBEDDED RESONATOR

BACKGROUND OF THE INVENTION

1. Field of the Invention

This invention relates generally to low pass filters for microwave signals. More particularly, it relates to providing improved frequency characteristics in the microwave spectrum for such filters.

2. Description of Related Art

The microwave portion of the spectrum, usually defined as extending from roughly 300 MHz to about 300 GHz, is used for wireless signals among various devices such as, for example, cellular telephones, personal digital assistants (PDAs), WiFi devices, and navigational systems.

Because many different devices concurrently use the microwave spectrum, government regulations and various agreements have divided it into discrete spectrum bands, which are often further split into smaller sub-bands, thereby minimizing interference. To meet such regulations and agreements, and to meet communication quality requirements, transmitting devices are generally prohibited from emitting energy over a specified level outside of their assigned bands and, preferably, receiving devices are constructed to limit receipt of energy to only their assigned bands Various microwave filters are therefore incorporated into transmitters and receivers, to limit their broadcast and receipt of signals, respectively, to particular frequencies. For this reason, the performance qualities of the microwave filters often have significant effect on the quality of communications and, further, are a determining factor for spacing between channels and, hence, the usable capacity of the spectrum.

Microwave filters may be configured to have low pass (LPF), band pass (BPF) or high pass (HPF) characteristics, each typically having at least one pass band, transition band and stop band.

For purposes of brevity this disclosure, however, will describe various exemplary embodiments and arrangements in reference to microwave LPFs. This is simply to focus the description on the novel features and aspects of the invention, to better enable persons of ordinary skill in the art to make and use it based on this disclosure. However, otherwise stated or clear from the context, the invention and all of its various embodiments may be readily practiced in alternative arrangements as microwave BPFs and/or HPFs simply by, for example, applying conventional filter design methods to translate or reconfigure the disclosed microwave LPFs to microwave BPFs or HPFs.

As known to persons skilled in the relevant arts, an ideal microwave LPF blocks all frequencies above a given cut-off frequency, has a zero-width transition band, and passes without attenuation all signal frequencies below the cut-off.

Realizable microwave LPFs, however, do not have such characteristics. Realizable microwave LPFs have pass band attenuation, meaning that some of desired signal energy is lost, a finite attenuation, meaning that some undesired signal energy gets through, and a slope-like transition band extending from the cut-off frequency to the reject band. Therefore, among the various measures of microwave LPF transmission quality, three are: stop-band attenuation, band-pass loss, and cut-off slope.

One well-known type of microwave LPF is the stepped-impedance resonator (SIR) filter, which comprises a succession of resonant sections, each section having a high impedance subsection that steps to a low impedance subsection. The resonant sections may be configured in various ways, such as coaxial, microstrip, or strip line.

FIG. 1 is a three-dimensional view of an exemplar coaxial SIR LPF 10 according to the related art, with its outer conductor removed for clarity.

As shown in FIG. 1, a traditional coaxial SIR LPF 10 may comprise a series of N resonator sections, each referenced as $\mathbf{12}_n$, n=1 to N. Each section $\mathbf{12}_n$ comprises a low impedance subsection $\mathbf{14}_n$ followed by a high impedance subsection $\mathbf{16}_n$ which, at microwave frequencies, embody a capacitor and an inductor, respectively. Each section $\mathbf{12}_n$ therefore forms an inductor-capacitor (LC) resonator.

FIG. 2 shows a lumped parameter model 20 for a coaxial SIR LPF such as the FIG. 1 exemplar 10.

Referring to FIG. 2, lumped parameter model 20 depicts an SIR LPF such as the FIG. 1 example 10, as comprising N resonator sections $\mathbf{22}_n$, each having an inductor element $L_n$ and a capacitor element $C_n$, each having a respective reactance value corresponding, in reference to FIG. 1, to the impedance of its modeled subsection $\mathbf{14}_n$ and $\mathbf{16}_n$. The relative values of $L_n$ and $C_n$, each set by physical parameters such as width, length and materials, in turn set the resonant frequency of each set $\mathbf{22}_n$. Therefore, an appropriate LPF characteristic may be obtained by selecting appropriate dimensions and materials for each section $\mathbf{12}_n$.

FIG. 3 shows an illustrative frequency response 30, based on an example seven-pole related art SIR LPF such as, for example, the FIG. 1 exemplar 10. Referring to FIG. 3, the example frequency response 30 has an example upper "cut-off" frequency, labeled 32, at approximately 5 GHz. The 5 GHz value in this example is arbitrary, but the form of the frequency response is representative of a related art seven-pole SIR LPF. The slope of the frequency response 34 above the example 5 GHz cut-off, labeled 32, is not very sharp. This is shown particularly by the attenuation 36 of only approximately 12 dB at approximately 5.5 GHz. Spurious modes may appear at 5.5 GHz, through, due to harmonics, or integral multiples of the resonant sections (not shown in FIG. 3) that form the SIP LPF.

There are known methods directed to solving the problem of spurious bands. All of these methods, however, have shortcomings.

For example, one method is to add another LPF, such as a mask filter, to the SIR LPF. This has drawbacks, though, including increased cost and, particularly, pass-band insertion loss. Further, adding a mask filter in line with a main filter may increase the complexity of the tuning procedure of the overall microwave system.

Another method is the addition of an arrangement of inductors, as described by U.S. Pat. No. 2,641,646 to Thomas. However, the method taught by Thomas may have many of the some of the same shortcomings as using an additional LPF. In addition, Thomas may require the use of heavy wire or copper tubing, materials that may not be appropriate for a low cost microwave LPF microwave cavity.

Another related method directed to solving the problem of spurious modes is taught by Published U.S. Patent Application No. 2003/0001697 to Bennett et al. Bennet teaches intermediate suppression elements, interspersed within the SIR structure. However, this method may require complete reconfiguration of the SIR filter structure

SUMMARY OF THE INVENTION

Accordingly, a need exists for a simply structured, easy to manufacture SIR LPF that has built-in suppression of close to pass band spurious signals. This invention and its various described exemplary embodiments are directed to this need and provide, with various other features and benefits, a SIR LPF having an embedded notch frequency resonator filter with a simple, easy to manufacture structure, readily implementing substantially any practical specification requirement for a spurious-free LPF.

According to one aspect of one or more embodiments, the embedded notch resonator filter may be formed by an inner conductor, integrated with a multi-pole filter such as an SIR-LPF, having a simple, integral structure that supports a dielectric spacer. This support structure and the dielectric spacer may, in arrangement with a face of a distal end of a transmission line, form a capacitive couple, of capacitance CC, coupling to a capacitance CR in parallel with an inductance LR, terminating to an effective ground, forming an LC resonator.

One aspect of one or more of the various exemplary embodiments includes a coaxial SIR LPF that has an inner conductor extending from a succession of resonant cavity sections, the inner conductor having at one distal end a projecting structure that supports a dielectric spacer having a gap thickness GP, the dielectric spacer abutting a distal end of a center conductor of a transmission line, to form the capacitance CR and inductance LR of an LC resonator, wherein CR is based, at least in part, on the gap thickness GP.

One aspect of one or more of the various exemplary embodiments includes an SIR LPF having a first center conductor that has, near one distal end, a step-down shoulder and a projection that extends a distance LN from the step-down shoulder to the distal end, a dielectric spacer with a hollow cylindrical portion surrounding the projection, and a flange, having a thickness GP, abutting the step-down shoulder, and a second center conductor with a distal end having a bore, arranged such that the hollow cylindrical portion of the dielectric spacer surrounding the projection extends into the bore, to form the capacitance CR and inductance LR of an LC resonator, wherein LR is based, at least in part, on the length LN.

According to another aspect of the various exemplary embodiments, the bore extends to a well-bottom surface in the second center conductor, the dielectric spacer includes an end wall at a distal end of the hollow cylindrical portion of the dielectric spacer, such that an annular face surrounding the bore at a distal end of the second inner conductor is spaced the gap distance GP by the flange from the step-down shoulder of the first center conductor, and the terminal end of the projection is spaced, by the end wall of the dielectric spacer, from the well-bottom surface of the recess.

According to another aspect of the various exemplary embodiments, simply varying the length LN of the projection varies the center frequency of the resonant notch frequency filter.

According to another aspect of the various exemplary embodiments, simply varying the length gap GP varies the maximum attenuation without significant change of the center frequency of the resonant notch frequency filter.

According to another aspect of the various exemplary embodiments, the second center conductor may be a distal end of a conventional coaxial transmission line, having a conventional center conductor readily drilled, machined, or otherwise formed by, for example, conventional tools, to have a recess with a diameter and length to accommodate the projection and the cylindrical portion of the dielectric spacer.

According to another aspect of the various exemplary embodiments, multiple sections of the resonant notch frequency filter may be cascaded together, to provide a wider stop band of desired rejection, and thereby attenuate multiple spurious modes.

The above-summarized objects, aspect and advantages of the invention and its various exemplary are only illustrative of those that can be achieved by the various exemplary embodiments, and are not intended to be exhaustive or limiting. These and other objects, aspects and advantages of the various exemplary embodiments will be apparent from the description herein, or can be learned from practicing the various exemplary embodiments, both as embodied herein or as modified in view of any variation which may be apparent to those skilled in the art.

BRIEF DESCRIPTION OF THE DRAWINGS

To better understand various exemplary embodiments, reference is made to the accompanying drawings, wherein.

DETAILED DESCRIPTION OF THE PREFERRED EMBODIMENTS OF THE INVENTION

Figure 1:
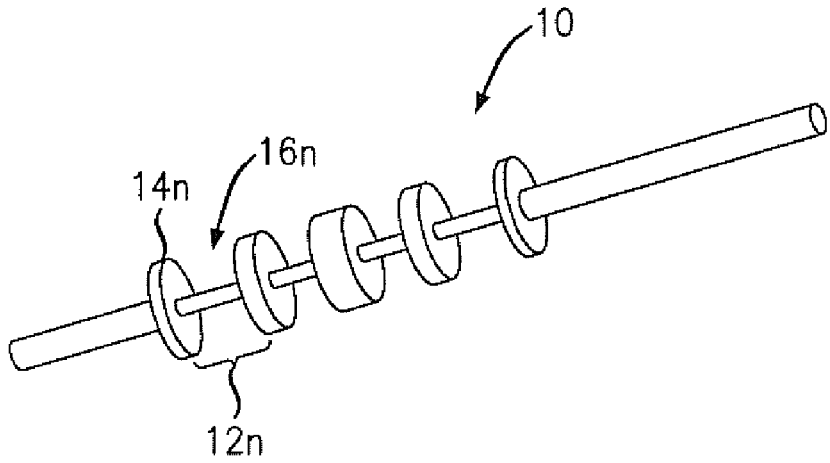
FIG. 1 PRIOR ART
FIG. 1 is a three-dimensional view of a coaxial SIR LPF according to the related art, with the outer conductor removed for clarity.
Figure 2:
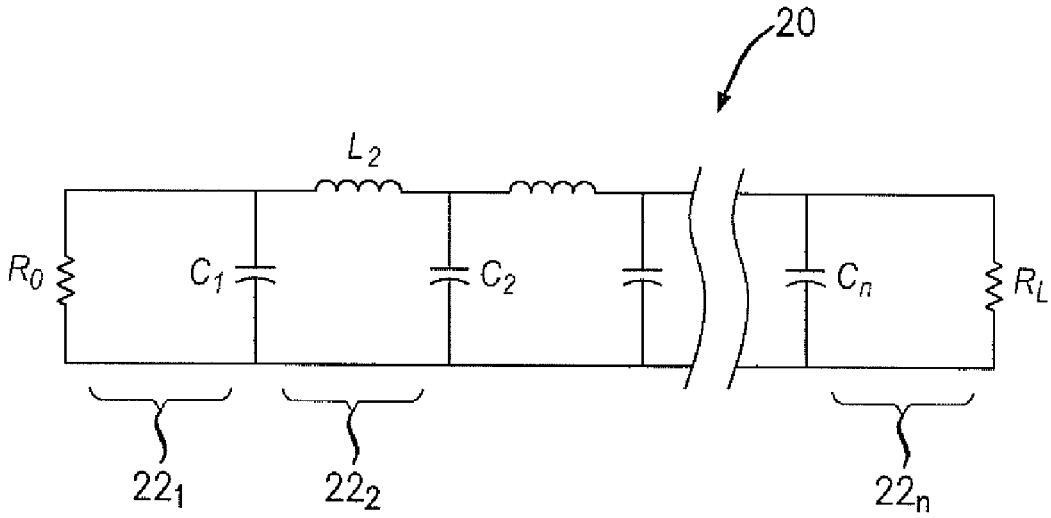
FIG. 2 PRIOR ART
FIG. 2 shows a lumped parameter model for a SIR LPF according to the related art.

Referring now to the drawings, in which like numerals refer to like components or steps, there are disclosed broad aspects of various exemplary embodiments.

In one broad aspect, a subject of this invention is an embedded resonator that may be integrated with various filter structures such as, for example, a coaxial SIR LPF. According to aspects having an SIR LPF, the embedded notch resonator introduces finite transmission zeros to the all transmission-pole response of the coaxial low-pass filter, which significantly enhances the spurious suppression of the coaxial filter. This provides an integrated filter/notch resonator having, among other features, sharp rejection near the operating band of the system, while maintaining a wide spurious suppression window.

Figure 4B:
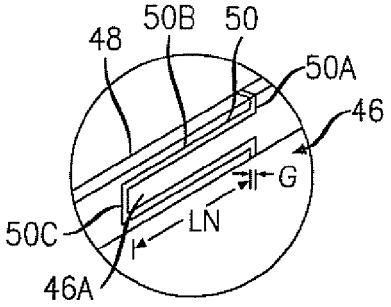
FIG. 4B is an enlargement of a cross-section of the example embedded resonator notch filter portion of the FIG. 4A example.
Figure 4A:
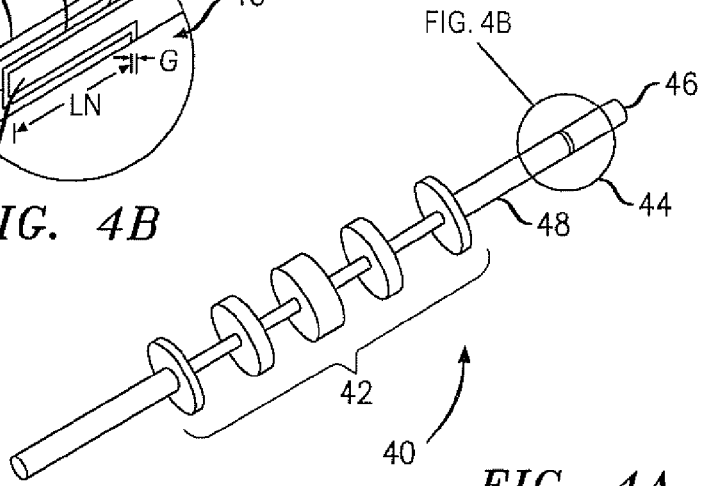
FIG. 4A is a three-dimensional depiction of one example SIR LPF with embedded resonator notch filter according to one embodiment.

FIG. 4A is a three-dimensional depiction of one example 40 having an SIR LPF 42 with an embedded resonator having structure including a capacitive coupling at region 44, according to one embodiment. FIG. 4B is an enlargement of a cross-section of portion 44.

Referring to FIG. 4B, a first transmission 46 is formed with a projection 46A, which extends into a bore (not separately labeled in FIG. 4B) formed in a second, abutting transmission line 48. Referring to FIG. 4A, in the depicted example the second transmission line is the distal end of an inner conductor extending from the SIR LPF 42. A dielectric spacer 50, having a flange portion 50A and a cylindrical sleeve portion 50B separates the projection 46A from the bore in 48, and separates the shoulder (not separately labeled in FIG. 4B) where the projection 46A extends from the transmission line 46 by a gap G from the opposite annular ring face (not separately labeled in FIG. 4B) of the second transmission line 48. In the FIG. 4B example, the dielectric spacer has an end wall 50C that separates a terminal end (not separately numbered in FIG. 4B) of the projection 46A from a well-bottom of the bore in the second transmission line 46. The thickness (not separately labeled in FIG. 4B) of the end wall 50C and the thickness of the walls (not separately labeled in FIG. 4B) of the cylindrical sleeve portion 50B are preferably, but are not necessarily, approximately the same thickness as G.

Figure 5:
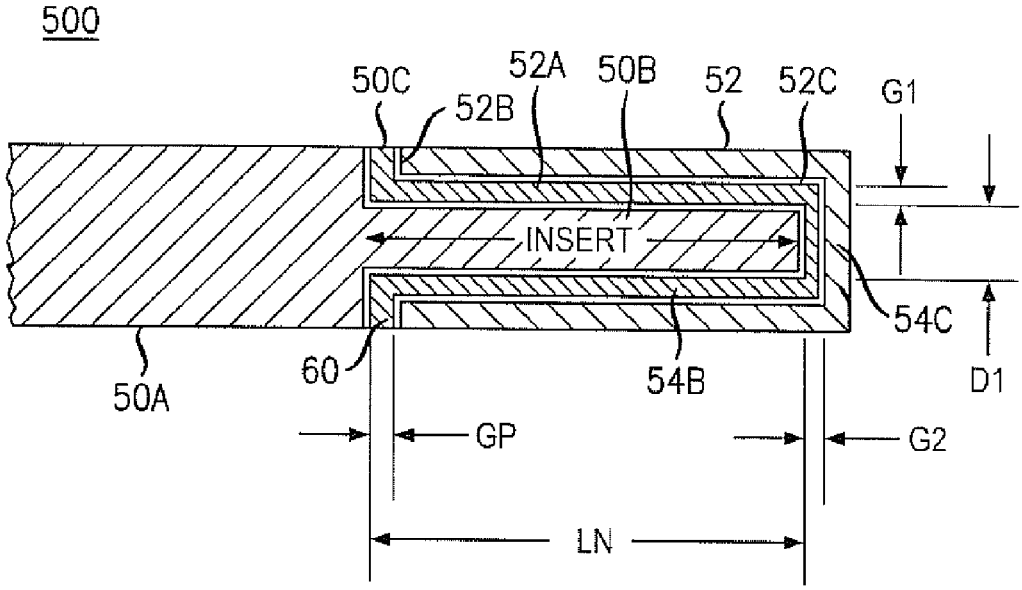
FIG. 5 is a further enlargement of the FIG. 4B example, showing one example gap and projection length.
Figure 6A:
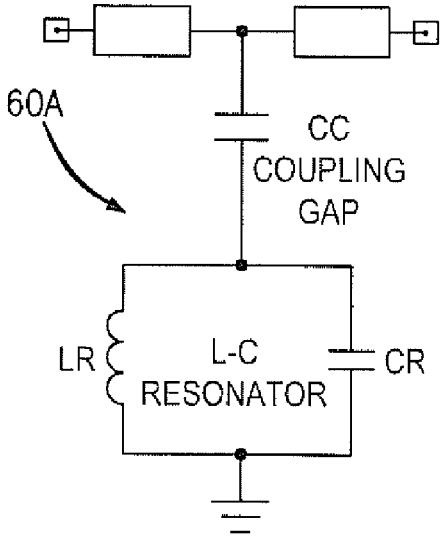
FIG. 6A shows a lumped element model of an example embedded resonator portion according to various embodiments.
Figure 6B:
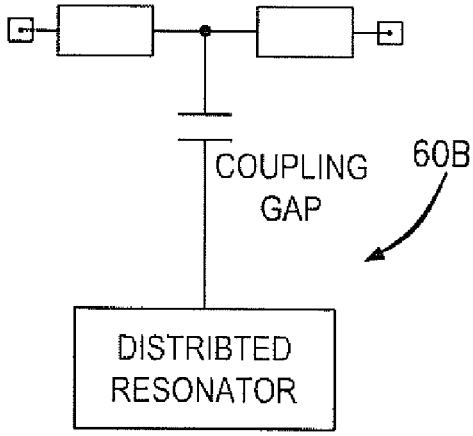
FIG. 6B shows a distributed model of an example embedded resonator portion according to various embodiments of the present invention.

As will be understood, and as explained in greater detail, opposing surfaces of the projection 46A and the bore in transmission line 48, and of the shoulder on line 46 with the annular face of transmission line 48, form an LC resonator. FIGS. 6A and 6B, described in greater detail in later sections, show a lumped-model and a distributed model, respectively, of the LC resonator. are FIG. 5 shows a further cross-sectional view of an example embedded resonator 500, generally structured according to FIG. 4B. The FIG. 5 example 500, however, in comparison to FIG. 4B has a reverse orientation as to which transmission line has the projection and which has the accommodating bore and, therefore, is separately numbered.

Referring to FIG. 5, the depicted example 500 comprises a first transmission line having 50A having, at its distal end, a projection 50B extending a length LN from a shoulder 50C. The projection has a diameter D1. The second transmission line 52 has, at its distal end facing the distal end 50A of the first transmission line, a bore surface 52A extending approximately LN from a annular face 52B at the extreme distal end of the line 52 to a well-bottom face 52C. The diameter of the bore 52B (not separately labeled) is preferably such that the cylindrical gap G1 existing between the outer surface of the projection 50B and the bore surface 52A is approximately the same as the gap GP separating the shoulder face 50C of the first transmission line from the annular face 52B of the second transmission line 52. Further, the extending length LN of the projection 50B is preferably such that the gap G2 separating the distal end of the projection 50B from the well-bottom face 52C of the bore is approximately the same as the gap GP.

With continuing reference to FIG. 5, a dielectric spacer (not collectively labeled) has a flange portion 54A of approximately thickness GP filling the space between the shoulder face 50C of the first transmission line 50 and the annular face 52B of the second transmission line. The dielectric spacer includes a sleeve portion 54B, having a thickness approximately equal to G1, surrounding the hollow cylindrical space between the outer surface of the projection 50B and the bore surface 52A. and has an end wall 54C within the space G2 separating the distal end of the projection 50B from the well-bottom face 52C of the bore.

FIG. 6A is a lumped element model 60A of an example embedded resonator according to one disclosed embodiment such as, for example, a structure as exemplified at FIG. 5.

Referring to FIGS. 5 and 6A, capacitance CR and inductance LR model as a parallel LC resonator the reactive impedance along the path of the shoulder 50C, the projection 50B, separated from the bore 52B by the dielectric spacer, and the capacitance CC models the coupling capacitance between the junction of the first transmission line 50B and the second transmission line 52 and the LC resonator. The length LN substantially sets the inductance LR, and the GP, G1 and G2 substantially set the capacitance CR. Therefore, as readily seen by persons skill in the art, the notch frequency is easily set.

FIG. 6B is a distributed model 60B of an example embedded resonator according to one disclosed embodiment such as, for example, a structure as exemplified at FIG. 5.

Figure 7:
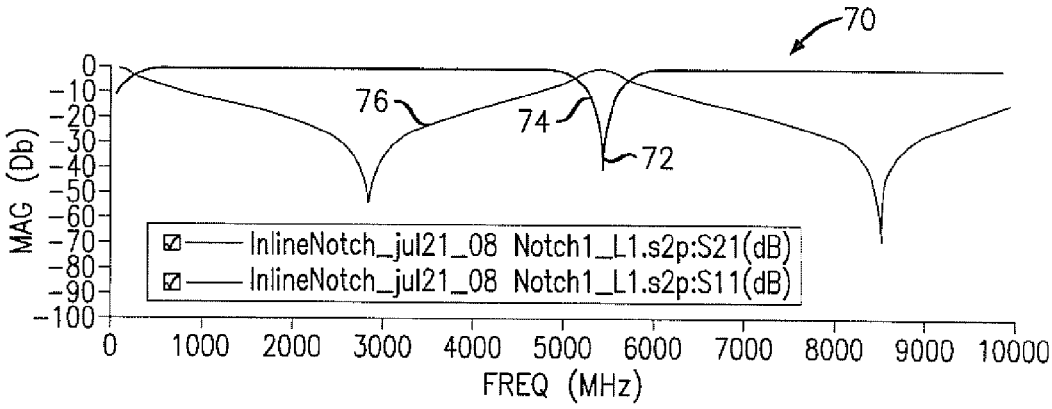
FIG. 7 is an illustration of one example frequency response obtainable from an embedded resonator implementing a one-pole resonator, according to various exemplary embodiments.

FIG. 7 is an illustration of one example frequency response obtainable from one example according to one embodiment, comprising one example SIR LPF having an example embedded one pole resonator, such as that achieved by the FIG. 5 structure, having LN and GP, G1 and G2 values selected for suppressing one spurious at 72 which, in the depicted example, is 5 GHz.

As seen at the plot section 74 of the S11 parameter shown in FIG. 7, the frequency response of the one pole resonator according to the FIG. 5 example embodiments has a sharp drop just above 5 GHz, increasing to a magnitude of almost −40 dB at the 5 GHz center frequency. Plot line 76 represents the S21 transmission parameter. The FIG. 7 frequency response is readily obtainable on a structure according to that depicted at FIG. 5, by selecting GP and LN dimensions based on this disclosure, using conventional computer modeling and design methods well known to persons of ordinary skill in the art.

Figure 3:
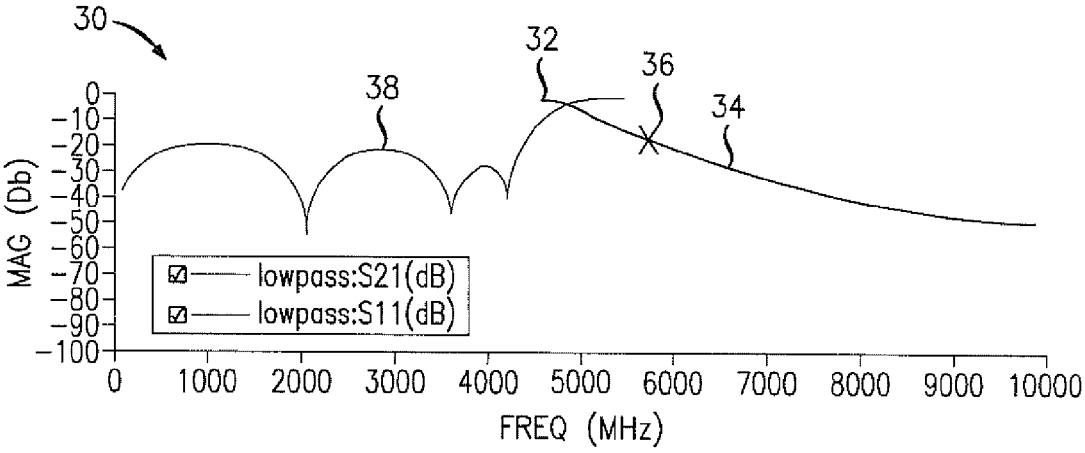
FIG. 3 PRIOR ART
FIG. 3 shows a frequency response diagram for a seven-pole LPF according to the related art.
Figure 8:
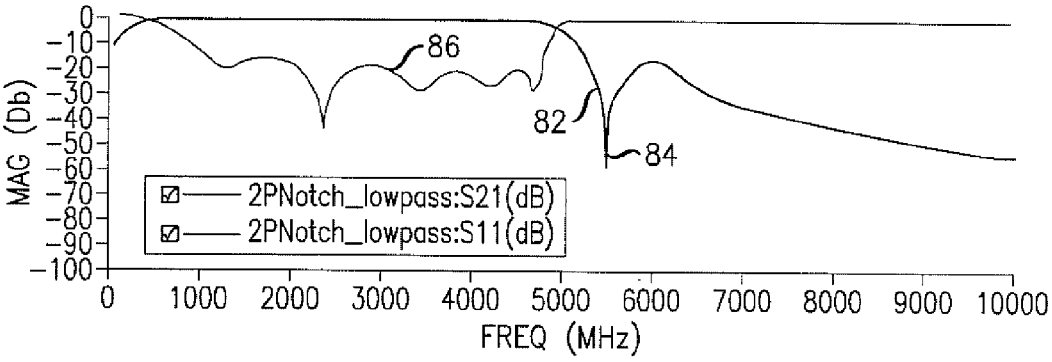
FIG. 8 is an illustration of one example frequency response obtainable from an example according to one embodiment, comprising an SIR LPF having an example embedded one pole resonator such as the FIG. 7 example.

FIG. 8 is an illustration of one example frequency response obtainable from an example according to one embodiment, comprising an SIR LPF such as modeled at FIG. 3, having an example embedded one pole resonator according to the invention, such as the FIG. 7 example.

As seen from the plot sections 82 and 84 of the S11 parameter shown in FIG. 8, compared to the FIG. 3 frequency response for the same SIR LPF, this embodiment provides substantially improved cut-off slope, including rejection of spurious mode signals occurring just above the operating frequency, e.g., 5 GHz at, with only a single pole implementation, a spurious signal suppression that exceeds −50 dB. Plot line 86 represents the S21 transmission parameter.

Figure 9:
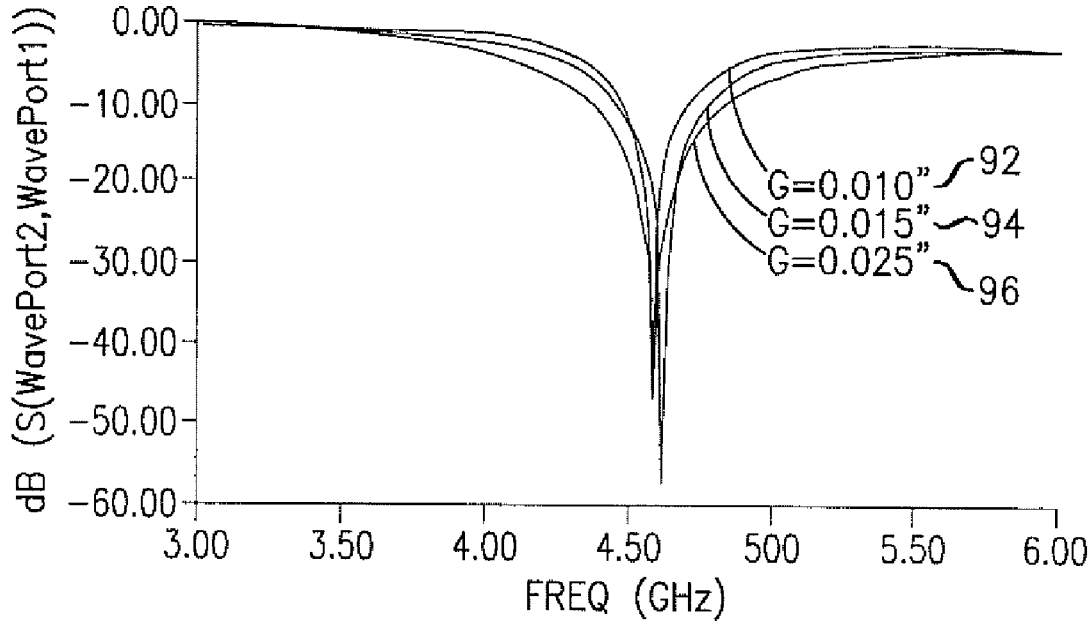
FIG. 9 shows one aspect according to various exemplary embodiments, of varying the notch frequency of the embedded one pole resonator portion by varying the gap which, according to one example, varies a CR value of the aspect's achieved LC resonator.

FIG. 9 shows one aspect according to various exemplary embodiments, of varying the maximum attenuation at the notch frequency of an embedded one pole, such as achieved by a structure as illustrated at FIG. 5, by varying the gap GP, G1 and G2 labeled in FIG. 5. This varies the coupling capacitance CC, and the resonant LC capacitance CR shown, for example, in the lumped parameter model at FIG. 6A. In the example variation of the gap GP shown in FIG. 9, an example LN value was fixed at about 1.2," setting a resonant frequency of roughly 4.5 GHz. Varying values of GP, using example 0.01", 0.015", and 0.025," labeled 92, 94 and 96, respectively, provides significant variation of the attenuation.

Example ranges and values of GP depend on various factors, including frequency requirements, environment, cost and manufacturability. For example, a square coaxial line may have an outer width of, for example, 0.235" and an inner diameter of, for example, 0.109". In such a case, the smallest practical gap, meaning easily manufactured with controllable quality, would have a dimension of about 0.01". Referring to FIGS. 5 and 6A, the LR value could then be adjusted, by setting LN, to fine tune the frequency response.

Figure 10:
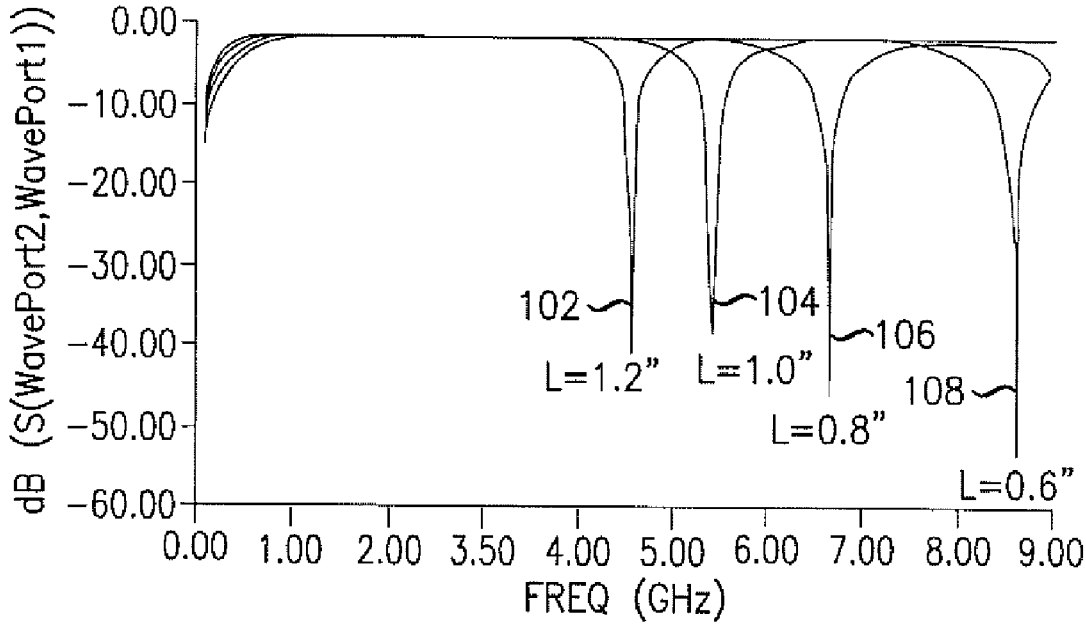
FIG. 10 shows one aspect according to various exemplary embodiments, of varying the notch frequency of the embedded one pole resonator by varying a length parameter which, according to one example, varies an LR value of the aspect's achieved LC resonator.

FIG. 10 shows one aspect according to various exemplary embodiments, of varying the notch frequency of an embedded one pole resonator, such as achieved by a structure as illustrated at FIG. 5, by varying the projection length labeled in FIG. 5 as LN which, as described above, varies the LR value of the aspect's achieved LC shown, for example, in the lumped parameter model at FIG. 6A.

Referring to FIG. 10, the lowest resonant frequency 102, obtained by setting LN=1.2", centered at only 4.6 GHz. Progressively higher resonant frequencies, labeled 104, 106 and 108, were obtained by decreasing LN to 1.0", 0.8", and 0.6", resulting in frequencies of 5.5 GHz, 6.7 GHz, and 8.6 GHz, respectively. This illustrates that the present embodiments provide not only a simple structure, but ready adjustment of resonant frequency by varying just one simple structural parameter, namely, the length LN of the projection. Thus, one may increase the central frequency of resonator 500 of FIG. 5 significantly by gradually decreasing the L value of resonator 500.

Figure 11:
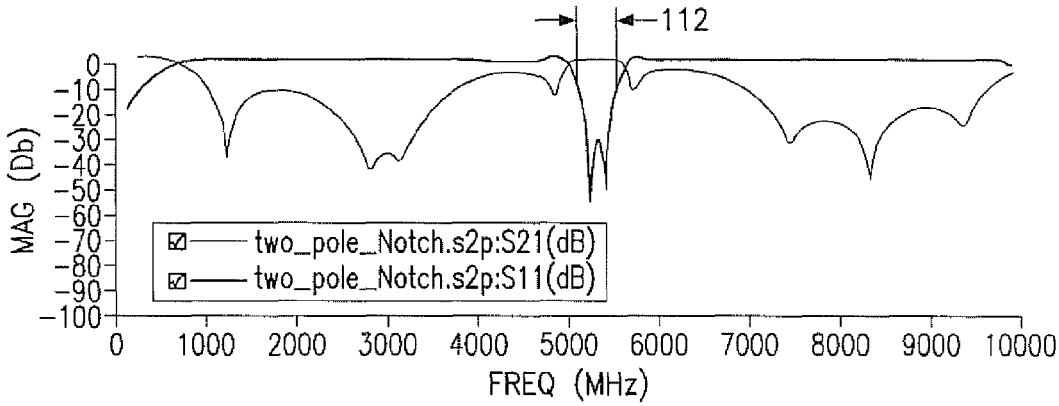
FIG. 11 is an illustration of one example frequency response obtainable from an embedded resonator implementing a two-pole resonator, according to various exemplary embodiments.

FIG. 11 is an illustration of one example frequency response obtainable from an embedded resonator implementing a two-pole resonator, according to various exemplary embodiments. Two poles are achieved by cascading two structures according to the embodiments, such as shown at FIG. 5, with appropriate gap GP and length LN values. Because this resonator embodiment has two poles, as opposed to the single pole of the resonator exhibiting the FIG. 8 response, the spurious stop band, such as labeled 112, is a wider band. As also shown, The magnitude of spurious mode suppression may, for example, have a magnitude of about −50 dB.

Figure 12:
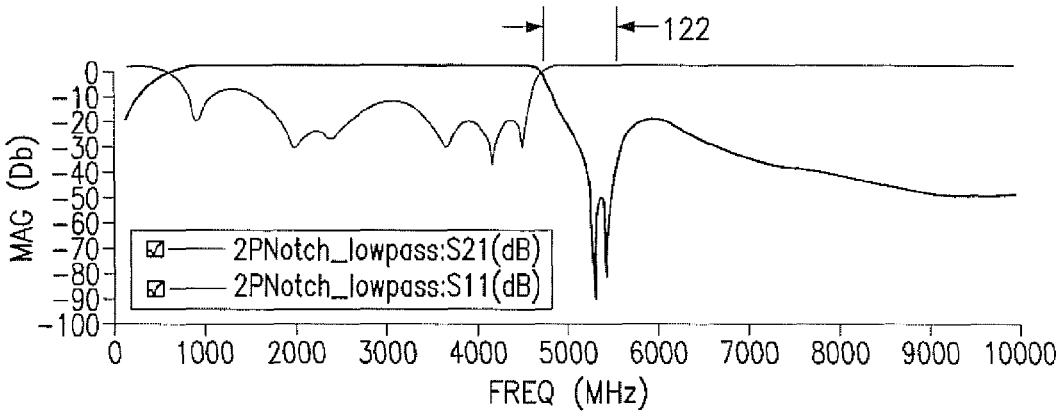
FIG. 12 is an illustration of one example frequency response obtainable from one example, according to one embodiment, comprising an SIR LPF having an example embedded two pole resonator such as the FIG. 11 example.

FIG. 12 is an illustration of one example frequency response obtainable from one example, according to one embodiment, comprising an SIR LPF, such as the sample represented at FIG. 3, having an example embedded two pole resonator such as the FIG. 11 example.

As seen the two pole resonator provides a large rejection band 122 above 5 GHz. The magnitude of spurious mode suppression may be as great as −60 dB for this embodiment.

Although the various exemplary embodiments have been described in detail with particular reference to certain exemplary aspects thereof, it should be understood that the invention is capable of other different embodiments, and its details are capable of modifications in various obvious respects.

For example, a plurality of embedded resonators such as shown at FIG. 5 could be integrated with an existing coaxial SIP LPF to realize a LPF function with finite transmission zeros.

Further, as can be readily seen by persons skilled in the relevant art, conventional microwave transformers may be inserted between the embedded resonators according to the disclosed embodiments, to provide a desired return loss characteristic.

As is readily apparent to those skilled in the art, variations and modifications can be affected while remaining within the spirit and scope of the invention. Accordingly, the foregoing disclosure, description, and figures are for illustrative purposes only, and do not in any way limit the invention, which is defined only by the claims.

What is claimed is:

1. A microwave filter, comprising:

a stepped impedance frequency filter section, having a plurality of resonator sections, arranged in a succession, each resonator section coupled to at least one other resonator section, an inner conductor coupled to at least one of the resonator sections and having a distal end, wherein the plurality of resonator sections are structured to provide a given pass band having a given sharpness of a given transition band, and a notch resonator coupled to the distal end of the inner conductor, said notch resonator comprising a first transmission line having a bore, a dielectric spacer arranged in the bore, the dielectric spacer having a second bore, a projection arranged to have a length LN within the second bore and to space the projection a gap GP from the bore, the projection connecting to a second transmission line, wherein the projection extending the length LN in the bore and the gap GP form an impedance equivalent to a coupling capacitance CC coupling to a resonant circuit comprising a parallel inductance LR and capacitance CR to a ground, and wherein the notch resonator has a notch frequency proximal to said pass band to provide the microwave filter with a transition band sharper than said given sharpness.

2. The microwave filter of claim 1, wherein the projection extends from a shoulder at a distal end of the first transmission line, and the second bore of the dielectric spacer extends in a longitudinal direction and wherein the dielectric spacer comprises a flange portion having a first face and a second face spaced a thickness GP from said first face, a cylindrical portion extending from the flange portion in the longitudinal direction, wherein said first face contacts said shoulder, said second face contacts a distal end of a center conductor of said seco d transmission line, and said projection extends into said bore.

3. The microwave filter of claim 1, wherein said first transmission line is an extension of a distal end of said inner conductor.

4. The microwave filter of claim 1, wherein said second transmission line is an extension of a distal end of said inner conductor.

5. The microwave filter of claim 1, wherein said inductance LR is substantially based on said length LN, and wherein said inductance LR, said capacitance CR and said capacitance CC form a resonator having a center frequency substantially dependent on said inductance LR.

6. The microwave filter of claim 1, wherein said coupling capacitance CC is based on said gap GP.

7. The microwave filter of claim 1, wherein said coupling capacitance CC and said capacitance CR are based on said gap GP, and wherein said inductance LR, said capacitance CR and said capacitance CC form a resonator having a center frequency substantially dependent on said inductance LR, and a minimum impedance substantially based on said gap GP.

8. A microwave filter comprising:

an inner transmission line having a first conductor section and a second conductor section;

a stepped-impedance resonator filter coupled to said first conductor section wherein the stepped-impedance resonator filter has a given pass band having a given sharpness of a given transition band; and a notch frequency filter section comprising a reactive element coupling said first conductor section to said second conductor section, said reactive element comprising a dielectric spacer having a thickness GP, wherein the dielectric spacer:

separates an axial distal end of the first conductor section from a facing distal end of the second conductor section, and separates a length LN of a projection of the first conductor section from a bore formed in the second conductor section, wherein said reactive element forms a coupling capacitance CC coupling to an LC resonator having a capacitance CR in parallel with an inductance LR, wherein the notch resonator has a notch frequency proximal to said pass band to provide the microwave filter with a transition band sharper than said given sharpness.

9. A method of designing a stepped-impedance low pass filter, comprising the following steps:

defining an upper limit of a pass band with a cut-off frequency;

identifying spurious frequencies that occur above said cut-off frequency;

identifying at least one pole value for suppression of said spurious frequencies;

modeling a circuit having a coupling capacitance CC value coupling to an LC resonator, the LC resonator having a parallel inductance LR and capacitance CR, with said coupling capacitance CC, said capacitance CR and said inductance LR respectively having values providing a resonant center frequency based on said at least one pole;

identifying a projection length LN and a gap dimension GP for a projection of length LN extending from a first transmission line into a bore formed in a second transmission line, based on said CC, CR and LR values;

providing a dielectric spacer based on said projection length LN and said gap dimension GP values;

forming a projection of said length LN on the first transmission line and a bore to accommodate the projection and the dielectric spacer in the second transmission line; and arranging the dielectric spacer on said projection and inserting said dielectric spacer and projection into said bore.

* * * * *

UNITED STATES PATENT AND TRADEMARK OFFICE

CERTIFICATE OF CORRECTION

PATENT NO. : 8,115,574 B2
APPLICATION NO. : 12/275523
DATED : February 14, 2012
INVENTOR(S) : Michael Joseph Adkins It is certified that error appears in the above-identified patent and that said Letters Patent is hereby corrected as shown below:

Column 8, claim 2, line 41, please change “seco d” to --second--.

Signed and Sealed this
Twentieth Day of March, 2012

David J. Kappos

David J. Kappos
*Director of the United States Patent and Trademark Office*